US005679011A

United States Patent [19]

Kobayashi et al.

[11] Patent Number: 5,679,011

[45] Date of Patent: Oct. 21, 1997

[54] SPARK PLUG DEVICE

[75] Inventors: Yoshinao Kobayashi; Mika Okada; Noriya Okamoto, all of Yokkaichi, Japan

[73] Assignee: Sumitomo Wiring Systems, Ltd., Japan

[21] Appl. No.: 538,752

[22] Filed: Oct. 3, 1995

Related U.S. Application Data

[63] Continuation-in-part of Ser. No. 216,663, Mar. 23, 1994, abandoned.

[30] Foreign Application Priority Data

Apr. 5, 1993 [JP] Japan ..... 5-103636

[51] Int. Cl.[6] ..... H01R 13/44

[52] U.S. Cl. ..... 439/125

[58] Field of Search ..... 439/125–128

[56] References Cited

U.S. PATENT DOCUMENTS 2,724,092 11/1955 Simpkins et al. ..... 439/125

3,803,529 4/1974 Rohrig et al. ..... 439/126

5,179,327 1/1993 Yagi et al. ..... 439/125

*Primary Examiner*—Gary F. Paumen

*Attorney, Agent, or Firm*—Jordan B. Bierman; Bierman, Muserlian and Lucas LLP

[57] ABSTRACT

In a spark plug device, an ignition cable (11) and a spark plug body (13) connected to each other through a terminal fixture (12) are covered with a tubular plug cap (14), on which a cap (15) and a rain cap (16) are mounted at its respective ends, and a cylindrical cover (17) which is made of a conductive rubber compound or a synthetic resin compound containing neither aluminum nor calcium as an element is fitted in the inner peripheral surface of the plug cap (14) in a portion corresponding to the terminal fixture (12) to fill a gap external to the terminal fixture (12), whereby the spark plug device prevents corona discharge adjacent the terminal fixture and has excellent durability and reliable insulation.

1 Claim, 4 Drawing Sheets

SPARK PLUG DEVICE

This Application is a Continuation-in-part of application Ser. No. 08/216,663, filed Mar. 23, 1994, now abandoned.

BACKGROUND OF THE INVENTION

1. Field of the Invention

The present invention relates to a spark plug device for a DOHC (double overhead camshaft) type gasoline engine or the like which has an ignition cable connected to a spark plug body and, more particularly, to a spark plug device capable of effectively preventing degradation of a plug cap by corona discharge.

2. Description of the Prior Art

An example of spark plug devices for DOHC type gasoline engines is shown in FIG. 3.

The spark plug device of FIG. 3 comprises a terminal fixture 53 shown in FIG. 4 which has a crimp-fixing portion 53*a* crimped and fixed to an end of an ignition cable 51 for electrical connection between the terminal fixture 53 and the ignition cable 51, and a front end portion 53*b* fitted to a terminal portion of a spark plug body 52 for electrical connection between the spark plug body 52 and the ignition cable 51.

The connected portion from the ignition cable 51 to the spark plug body 52 is covered with a relatively long tubular plug cap 54 made of synthetic resin. A rain cover 55 to be fitted to a plug hole of an engine is mounted on the plug cap 54 at its one end on the ignition cable side, and a rubber cap 56 is mounted on the plug cap 54 at its other end on the spark plug body side.

The above-mentioned spark plug device has a gap between the outer peripheral surface of the terminal fixture 53 and the inner peripheral surface of the plug cap 54. When the spark plug body 52 has a high discharge voltage (for example, more than 30 KV), a potential gradient at a surface of the plug cap 54 of synthetic resin is not less than 3 KV/mm, which is prone to corona discharge in the air adjacent the terminal fixture 53, resulting in the likelihood of not only lowering of insulation of the plug cap 54 with degradation thereof by corona discharge but also pin holes due to dielectric breakdown.

SUMMARY OF THE INVENTION

According to a first aspect of the present invention, a spark plug device comprises an ignition cable, a spark plug body having a terminal, a terminal fixture connected to an end of the ignition cable and fitted to the terminal of the spark plug body, a tubular plug cap for covering the spark plug body through to the ignition cable, and a filler material for filling a gap formed between the outer peripheral surface of the terminal fixture and the inner peripheral surface of the plug cap. In the spark plug device of the first aspect, the filler material is made of a conductive rubber compound.

According to a second aspect of the present invention, a spark plug device comprises an ignition cable, a spark plug body having a terminal, a terminal fixture connected to an end of the ignition cable and fitted to the terminal of the spark plug body, a tubular plug cap for covering the spark plug body through to the ignition cable, and a filler material for filling a gap formed between the outer peripheral surface of the terminal fixture and the inner peripheral surface of the plug cap. In the spark plug device of the second aspect, the filler material is made of an insulative synthetic resin compound containing neither aluminum nor calcium as an element.

According to a third aspect of the present invention, a spark plug device comprises an ignition cable, a spark plug body having a terminal, a terminal fixture connected to an end of the ignition cable and fitted to the terminal of the spark plug body, a tubular plug cap for covering the spark plug body through to the ignition cable, and a filler material for filling a gap formed between the outer peripheral surface of the terminal fixture and the inner peripheral surface of the plug cap. In the spark plug device of the third aspect, the filler material is made of a conductive synthetic resin compound containing neither aluminum nor calcium as an element.

In the spark plug device of the first and third aspects of the present invention, by virtue of the presence of the conductive filler material, no layer of air exists between the plug cap and the terminal fixture and further the plug cap and the terminal fixture becomes the same potential, thereby preventing corona discharge.

The spark plug device of the second and third aspects of the present invention produces no deliquescent conductive deposit such as aluminum salt or calcium salt, even if the corona discharge occurs, and prevents formation of the continuous conduction passageway which extends from the inner surface to outer surface of the plug cap, resulting in no outward energy leak.

When the insulative synthetic resin compound containing neither aluminum nor calcium as an element is used as the filler material, the insulation thickness of the plug cap substantially increases by the presence of the insulative material, whereby the pin holes due to the dielectric breakdown are not liable to be produced. When the rubber compound is used as the filler material, abrasion of the head of the spark plug body and inner surface of the plug cap due to vibration is alleviated.

An object of the present invention is to provide a spark plug device which prevents corona discharge adjacent a terminal fixture and has excellent durability and reliable insulation.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
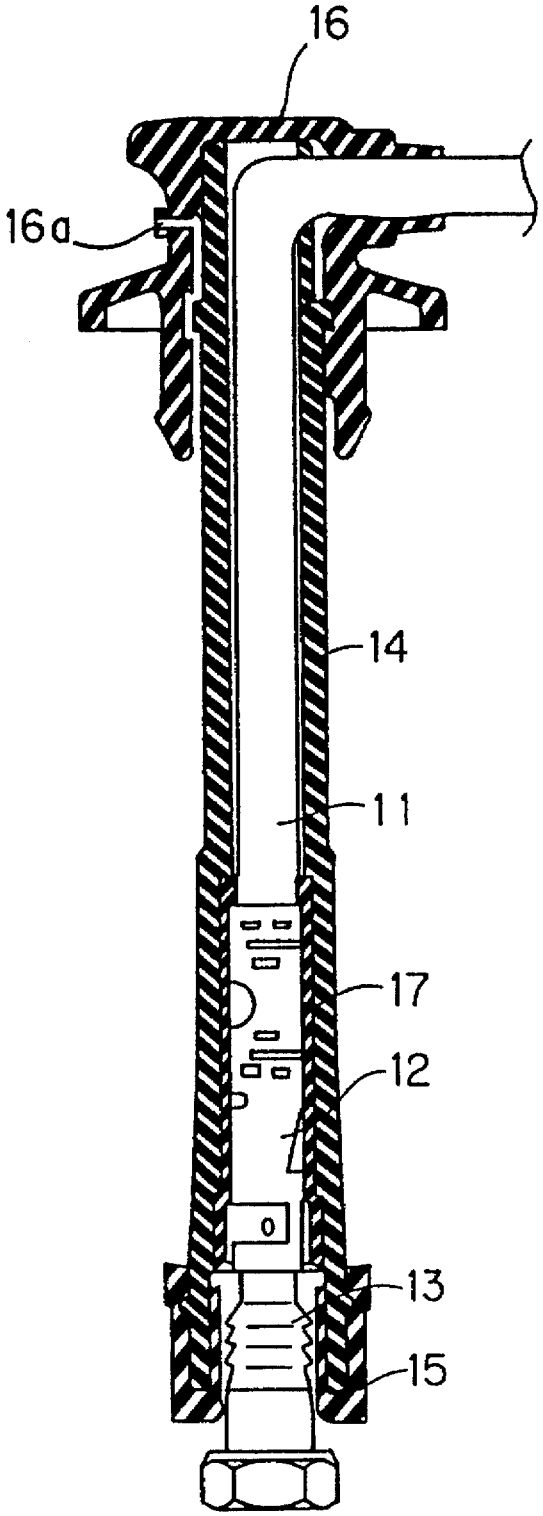
FIG. 1 is a sectional view of a preferred embodiment according to the present Invention.
Figure 2:
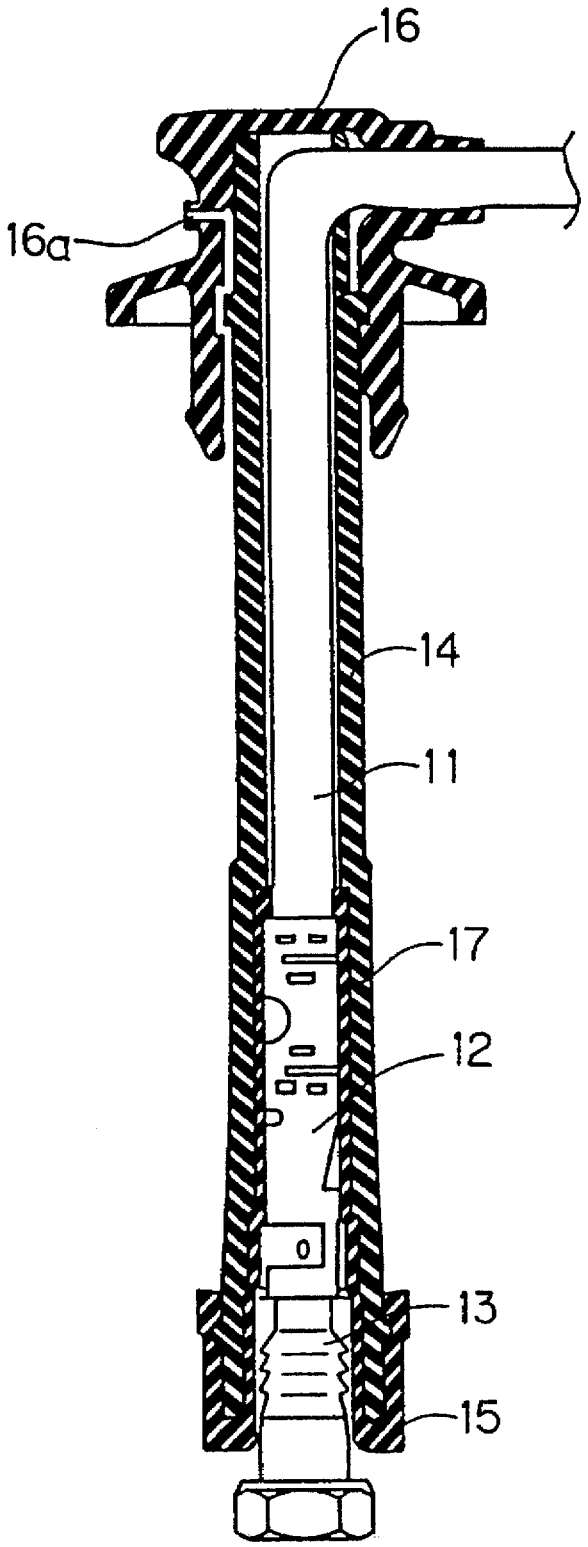
FIG. 2 is a sectional view of another preferred embodiment according to the present Invention.
Figure 3:
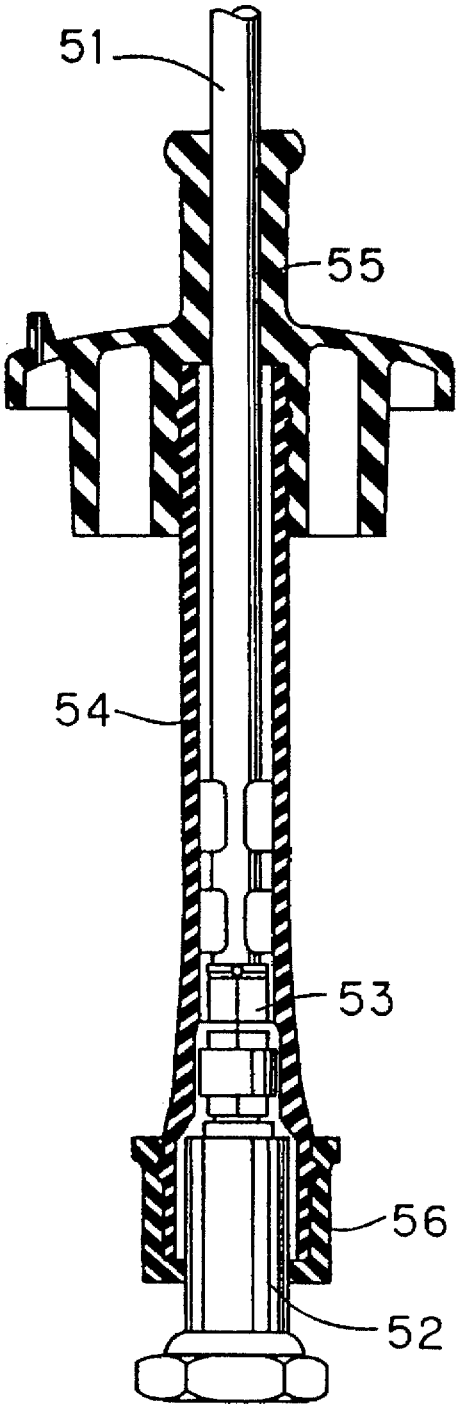
FIG. 3 (PRIOR ART)
FIG. 3 is a sectional view of the prior art.
Figure 4:
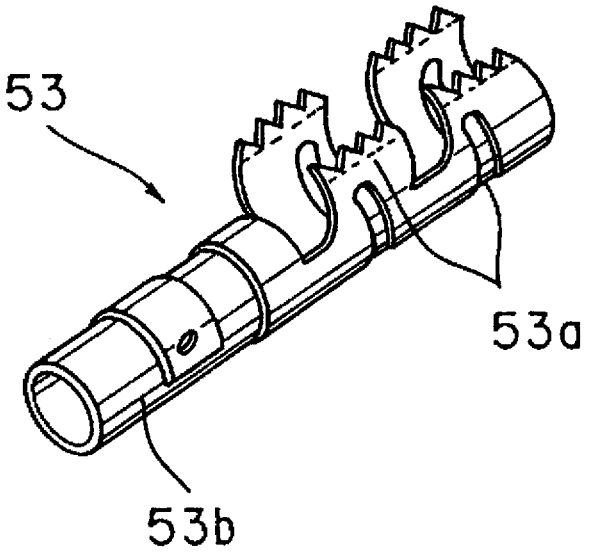
FIG. 4 (PRIOR ART)
FIG. 4 is a perspective view of a terminal fixture of the prior art.

Referring to the drawings, a preferred embodiment will be described hereinafter according to the present invention. As shown in FIG. 1, a terminal fixture 12 is crimped and fixed to an end of an ignition cable 11 for electrical connection between the ignition cable 11 and the terminal fixture 12. A front end of the terminal fixture 12 is fitted to a terminal portion of a spark plug body 13 for electrical connection between the ignition cable 11 and the spark plug body 13.

The ignition cable 11 and spark plug body 13 electrically connected to each other through the terminal fixture 12 are covered with a plug cap 14 of elongated, tubular configuration like the prior art made of synthetic resin such as PBT (polybutylene terephthalate) and UP (unsaturated polyester resin). A cap 15 made of rubber is fitted in and on the plug cap 14 at its one end or lower end. A rain cover 16 made of rubber or the like is fitted over the plug cap 14 at its other end or upper end, and an air bent hole 16*a* is formed exteriorly of the rain cover 16.

A cylindrical cover 17 made of a rubber compound which is fluid, elastic if hardened and made conductive by mixing graphite or furnace black therein, such as silicone rubber, is fitted in the inner periphery of the plug cap 14 in a portion corresponding to the terminal fixture 12 to fill the gap external to the terminal fixture 12.

Thus, when the conductive rubber compound fills a gap between the plug cap 14 and the terminal fixture 12, even if any slight gap partly remains, the plug cap 14 and the terminal fixture 12 become the same potential, thereby preventing corona discharge. Furthermore, a compound made by mixing an inorganic filler into polychloroprene, chlorinated polyethylene, chlorosulfonated polyethylene (Hypalon: the trade name of du Pons), ethylene propylene diene terpolymer (EPDM), acrylic rubber, silicone rubber, self oil breed type silicone rubber, fluorosilicone rubber, fluorocarbon rubber or the like is suitably used as the rubber compound. The compound becomes conductive when graphite or furnace black (Ketjen Black: the trade name of Akzo for carbon black, and the like) is mixed therein.

When corona discharge is generated by the presence of a slight layer of air between the cylindrical cover 17 and the terminal fixture 12, the cylindrical cover 17 made of silicone rubber, if containing a metallic element such as aluminum or calcium, produces no conductive deposits such as aluminum salt or calcium salt, thereby preventing outward energy leaks and non-discharge of the spark plug body 13.

In this preferred embodiment, as above described, the conductive rubber compound such as silicone rubber is used as the cylindrical cover 17. The material used for the cylindrical cover 17, however, is not limited as above, and a synthetic resin compound, rather than rubber compound, may be used. If the cylindrical cover 17 which is made of the synthetic resin compound, other than rubber compound, contains aluminum or calcium, ozone gas ($O_3$) generated by the corona discharge chemically reacts with nitrogen gas ($N_2$) in the air to produce nitrate ions ($NO_3$—), which in turn react with aluminum or calcium in the cylindrical cover 17 to produce deliquescent $Al(NO_3)_3$ or $Ca(NO_3)_2$. A continuous conduction passageway is thus formed which extends from the inner surface to outer surface of the cylindrical cover 17, resulting in electrical energy leaks.

For this reason, the material of the cylindrical cover 17, if the synthetic resin compound is other than a rubber compound, preferably contains neither aluminum nor calcium. Furthermore, a compound made by mixing silica ($SiO_2$) powder or quartz fiber as an inorganic filler into polybutylene terephthalate (PBT), polycyclohexene terephthalate (PCT), polyimide (PI), polyether imide (PEI), polyalylate (PAR), polyether ether ketone (PEEK), polyphenylene sulfide (PPS), polyphenylene ether (PPE), unsaturated polyester (UP), epoxy resin, diallyl phthalate or the like is suitably used as the synthetic resin compound.

When the cylindrical cover 17 is made of the synthetic resin compound containing neither aluminum nor calcium, almost no layer of air external to the terminal fixture 12 prevents corona discharge adjacent the terminal fixture 12 if the discharge voltage of the spark plug 13 is high. This also prevents lowering of insulation of the plug cap 14 made of synthetic resin with degradation thereof by corona discharge and pin holes due to dielectric breakdown.

Moreover, when the cylindrical cover 17 made of the synthetic resin compound containing neither aluminum nor calcium is made conductive by mixing graphite or furnace black (Ketjen Black: the trade name of Akzo for carbon black, and the like) therein, like in the case of the rubber compound, the plug cap 14 and the terminal fixture 12 becomes the same potential, even if any slight gap partly remains therebetween, thereby preventing corona discharge more effectively.

In this preferred embodiment, as above described, the cylindrical cover 17 is fitted in the plug cap 14 as a separate filler material. However, the cylindrical cover 17 and the plug cap 14 may be integrally formed, where the inner peripheral surface of the plug cap 14 is coated with the rubber compound or the synthetic resin compound as discussed above. Otherwise, the gap between the terminal fixture 12 and the plug cap 14 may be filled with the rubber compound or the synthetic resin compound as discussed above.

Although the cylindrical cover 17 and the cap 15 are separate members in this preferred embodiment, the cylindrical cover 17 and the cap 15 may be integrally formed of the same material. In this case, since the cap 15 is needed to be insulative, an insulative synthetic resin compound containing neither aluminum nor calcium should be used as the material of the cylindrical cover 17 and the cap 15.

While the invention has been shown and described in detail, the foregoing description is in all aspects illustrative and not restrictive. It is therefore understood that numerous modifications and variations can be devised without departing from the scope of the invention.

We claim:

1. A spark plug device comprising:

an ignition cable, a spark plug body having a terminal, a terminal fixture connected to an end of said ignition cable and fitted to the terminal of said spark plug body, a tubular plug cap for covering said spark plug body through to said ignition cable, and a filler material for filling a gap formed between the outer peripheral surface of said terminal fixture and the inner peripheral surface of said plug cap, wherein said filler material is made of a conductive rubber compound.

* * * * *